US005671918A

United States Patent [19]

Hofmann et al.

[11] Patent Number: 5,671,918

[45] Date of Patent: Sep. 30, 1997

[54] SHEET DELIVERY FOR A SHEET-PROCESSING MACHINE

[75] Inventors: Wolfram Hofmann, Hesseneck; Mario Koch, Reilingen, both of Germany

[73] Assignee: Heidelberger Druckmaschinen AG, Heidelberg, Germany

[21] Appl. No.: 532,169

[22] Filed: Sep. 22, 1995

[30] Foreign Application Priority Data

Sep. 24, 1994 [DE] Germany ..... 44 34 190.3

[51] Int. Cl.[6] ..... B65H 29/68

[52] U.S. Cl. ..... 271/182

[58] Field of Search ..... 271/177, 182, 271/183, 195, 202, 203, 204, 211, 309, 97; 138/44

[56] References Cited

U.S. PATENT DOCUMENTS

| | | | |
|---|---|---|---|
| 949,935 | 2/1910 | Maxson | 271/177 |
| 3,556,519 | 1/1971 | Keller | 271/177 |
| 4,372,550 | 2/1983 | Woods . | |
| 4,643,414 | 2/1987 | Weisgerber . | |
| 5,029,835 | 7/1991 | Blaser et al. | 271/195 X |
| 5,110,110 | 5/1992 | Wirz et al. | 271/97 X |
| 5,379,999 | 1/1995 | Barzideh et al. | 271/204 X |
| 5,445,372 | 8/1995 | Blaser et al. | 271/204 X |

FOREIGN PATENT DOCUMENTS

| | | | |
|---|---|---|---|
| 3413179 | 10/1985 | Germany . | |
| 2 037 259 | 7/1980 | United Kingdom . | |
| 2 156 786 | 10/1985 | United Kingdom . | |
| 2399 | 2/1994 | WIPO | 271/195 |

OTHER PUBLICATIONS

Wilmer, "Document Transport," Mar. 1962, IBM Tech. Disclosure Bulletin, vol. 4, No. 10, p. 8.

*Primary Examiner*—Boris Milef

*Attorney, Agent, or Firm*—Herbert L. Lerner; Laurence A. Greenberg

[57] ABSTRACT

Sheet delivery for a sheet-processing machine includes a conveyor system for transporting sheets successively and for releasing the sheets above a sheet pile having a horizontal surface, and a plurality of ventilators or air blowers having a controllable output, the ventilators being disposed in an array above the horizontal surface of the sheet pile for directing blown air from above the sheet pile towards respective oncoming sheets successively transported by the conveyor system and released thereby above the sheet pile, the ventilators being high-speed ventilators constructed for small air volumes and blowing, at a high flow rate, a concentrated air jet with laminar flow substantially vertically from above against the respective oncoming sheets.

4 Claims, 3 Drawing Sheets

SHEET DELIVERY FOR A SHEET-PROCESSING MACHINE

BACKGROUND OF THE INVENTION

Field of the Invention:

The invention relates to a sheet delivery for a sheet-processing machine, in particular, a sheet-fed printing machine, wherein a plurality of ventilators or air blowers having a controllable output are disposed in an array above a sheet pile having a horizontal surface, for directing blown air from above the sheet pile towards successively oncoming sheets transported by a conveyor system and releasable by the conveyor system above the sheet pile.

This state of the art has become known heretofore from the published German Application DE 34 13 179 A1. A conveyor system formed of a pair of endless conveyor chains revolving parallel to one another is provided to convey the sheets from the sheet-processing machine to a delivery pile, the conveying chains having gripper bars or gripper carriages fastened thereto at spaced distances behind one another. Sheet grippers are provided on the gripper bars or gripper carriages for gripping a respective sheet at a leading edge thereof and for transporting the sheet to the sheet pile and releasing it thereat. The sheet initially oncoming at machine speed must be braked in the shortest possible way after being released by the sheet grippers, and smoothly deposited on the sheet pile so that the edges of the sheets are closely aligned to produce smooth lateral pile surfaces. For this purpose, the sheet delivery of the conventional arrangements of this general type have a plurality of blowers disposed above the sheet pile and distributed adjacent one another across the width or breadth of the sheets, and also behind one another in the sheet-conveying direction, the blowers being controllable independently of one another in order to subject a respective sheet partially to blowing air from above, taking the paper quality, the print product, the machine speed, the sheet format and other parameters into account, thereby braking or slowing the respective sheet down and depositing it on the sheet pile in a straight-edge smooth manner. The control of the blowers permits the formation of either an air bell, a wave form or any other deformation of the respective sheet to assure a precise sheet deposit. For this purpose, slowly rotating axial blowers performing 1000 to 3000 revolutions per minute are employed, relatively large amounts of the blown air being discharged at a relatively low flow rate from the blowers turbulently and, thus, in confused directions, and consequently impacting with large areas of the sheet surface. The abduction or diversion of the large quantities of blown air is very problematic and may also easily result unintentionally in a mutual influence being exerted upon the application of the blown air to the sheet which is to be deposited, with the interference or disruptions resulting therefrom.

SUMMARY OF THE INVENTION

It is accordingly an object of the invention to provide a sheet delivery for a sheet processing machine of the foregoing general type wherein the application of blown air to a sheet to be deposited therein is improved in order to deposit sheets of differing quality smoothly and precisely on the sheet pile, even at high machine speeds.

With the foregoing and other objects in view, there is provided, in accordance with the invention, a sheet delivery for a sheet-processing machine, comprising a conveyor system for transporting sheets successively and for releasing the sheets above a sheet pile having a horizontal surface, and a plurality of ventilators or air blowers having a controllable output, the ventilators being disposed in an array above the horizontal surface of the sheet pile for directing blown air from above the sheet pile towards respective oncoming sheets successively transported by the conveyor system and released thereby above the sheet pile, the ventilators being high-speed ventilators constructed for small air volumes and blowing, at a high flow rate, a concentrated air jet with laminar flow substantially vertically from above against the respective oncoming sheets.

In accordance with another feature of the invention, the ventilators are radial-type ventilators having respective spiral housings.

In accordance with a further feature of the invention, the ventilators are diagonal-type ventilators having respective attachments formed as guide wheels acting as respective flow-aligning devices.

In accordance with an added feature of the invention, the ventilator are formed with respective venturi tubes at respective discharge sides thereof.

In accordance with a concomitant feature of the invention, the sheet delivery includes additional blast-air devices in combination with the plurality of ventilators.

Thus, unlike the initially described former state of the art, the features of the invention permit the application of air purposefully to limited surface areas, with a relatively low air volume and at a relatively high flow rate. A result thereof, is that there is neither an air-discharge problem nor do the air flows leaving the individual ventilators have any effect upon or influence one another. Another marked advantage stems from the substantially laminar flow of the concentrated air current. The possibilities of controlling purposefully directed air currents of relatively low air volumes are improved considerably.

Radial-type ventilators having a respective spiral housing, or diagonal-type ventilators having a respective attachment formed of a guide wheel which, for example, may be constructed as a flow-aligning device are particularly suitable for this purpose.

According to the an embodiment of the invention, the ventilators may be provided in combination with other blast-air devices, such as blast blast pipes or the like.

Other features which are considered as characteristic for the invention are set forth in the appended claims.

Although the invention is illustrated and described herein as embodied in a sheet delivery for a sheet processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
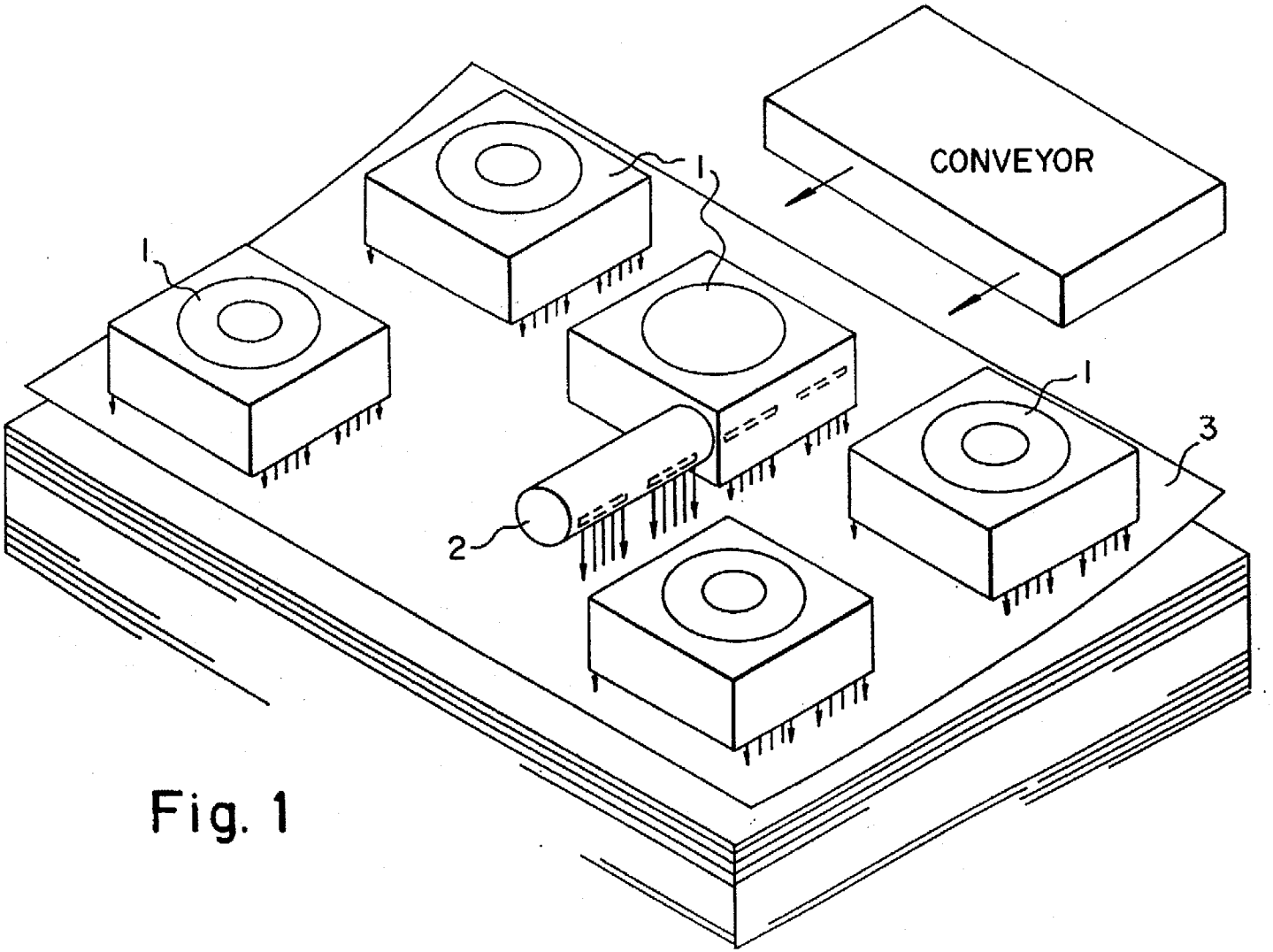
FIG. 1 is a top, front and side perspective view of a plurality of ventilators or air blowers assembled in an array extending over the width or breadth and the length of a sheet.

Referring now to the drawings and, first, particularly to FIG. 1 thereof, there is shown therein, in a realization of the features of the invention, a plurality of ventilators or air blowers 1 disposed adjacent one another over the width or breadth of a sheet 3, and behind one another, as seen in the sheet transport direction. Additional blast or blowing-air devices such as air-blast pipes 2 are provided in combination with the ventilators or air blowers 1. Outlet openings of the ventilators or air blowers 1 and the other air-blast devices 2 are directed downwardly so that the respective oncoming sheet may be subjected to blast air from above, taking paper quality, print product, sheet size as well as other parameters into account, in order to brake or slow down the respective sheet 3 oncoming at machine speed and being released by the grippers of the conveying system, and to deposit the sheet 3 on the sheet pile 4 in a straight-edge manner.

All blast-air devices, in particular, the ventilators or air blowers 1, are constructed so that a relatively small quantity of air having a high flow rate is directed against the surface of the oncoming sheet 3. In accordance with the outlet openings of air-blast pipes 2, the outlet openings of the ventilators or air blowers 1 are of slit-shaped construction or are arranged in rows behind one another as well as side by side, respectively, as represented by the arrows in FIG. 1.

Figure 3:
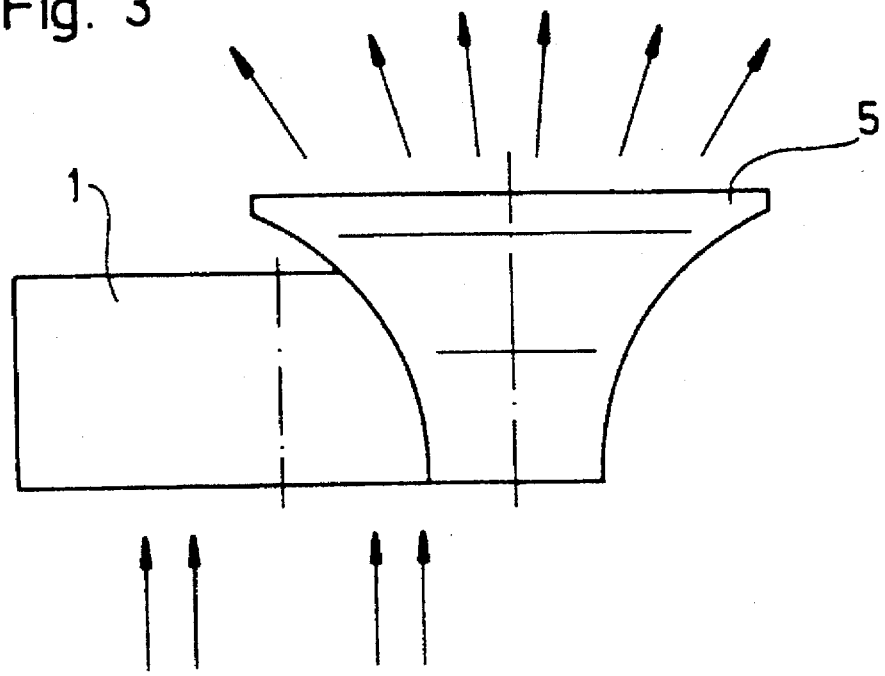
FIG. 3 is a view of the radial-type ventilator or air blower of FIG. 2 shown rotated through 90°.
Figure 2:
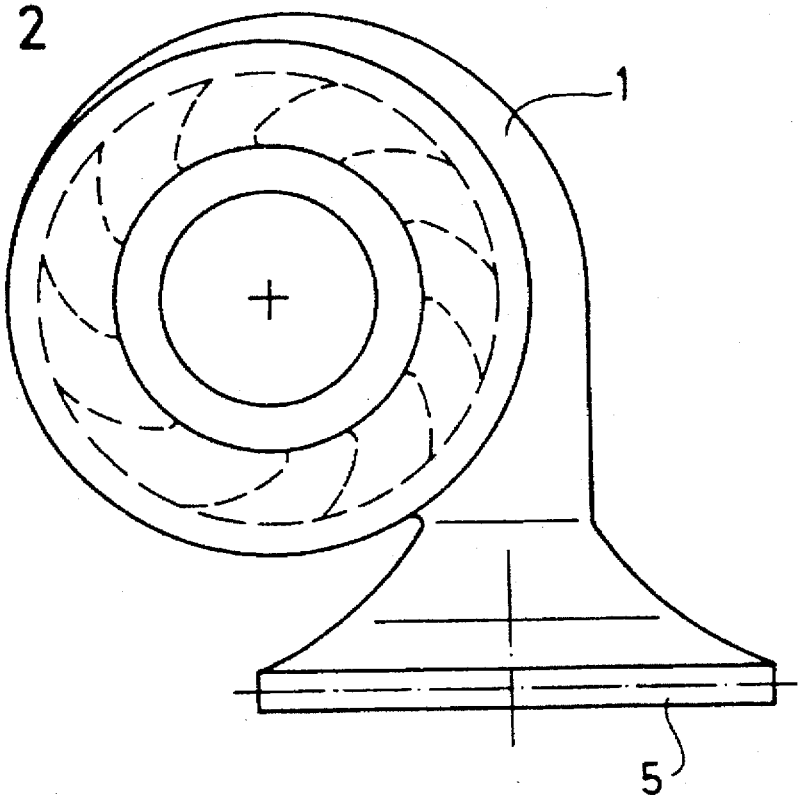
FIG. 2 is a side elevational view of a radial-type ventilator or air blower having a slit nozzle.

To achieve this objective, radial-type ventilators or air blowers having a respective spiral housing in accordance with the construction shown in FIGS. 2 and 3 are used. The radial-type ventilators or air blowers are suitably adapted for operating with a small amount of air and for ejecting the air at a high flow rate from the ventilator. Preferably the respective slit-shaped outlet opening of the radial-type ventilator is formed as a venturi tube 5 which causes the relatively small amount of air of the high-speed radial-type ventilator to be accelerated by the venturi tube 5, and thereby impinge, at a relatively high flow rate, on the upper side of the oncoming sheet 3. Advantageous, the air being discharged from the radial-type ventilator 1 is blown, over a given section, linearly against the upper side of the oncoming sheet 3. The linear discharge or ejection of blast air may be selectively aligned so as to be parallel to the sheet-conveying direction or so as to be in an angular position relative thereto, in order thereby to produce a force component respectively parallel or transverse to the sheet-conveying direction. Good use may be made of this feature, by directing the blowing or blast-air jet at an inclination or obliquely to the sheet-conveying direction, so as to activate drag forces for smoothening the sheet.

Figure 5:
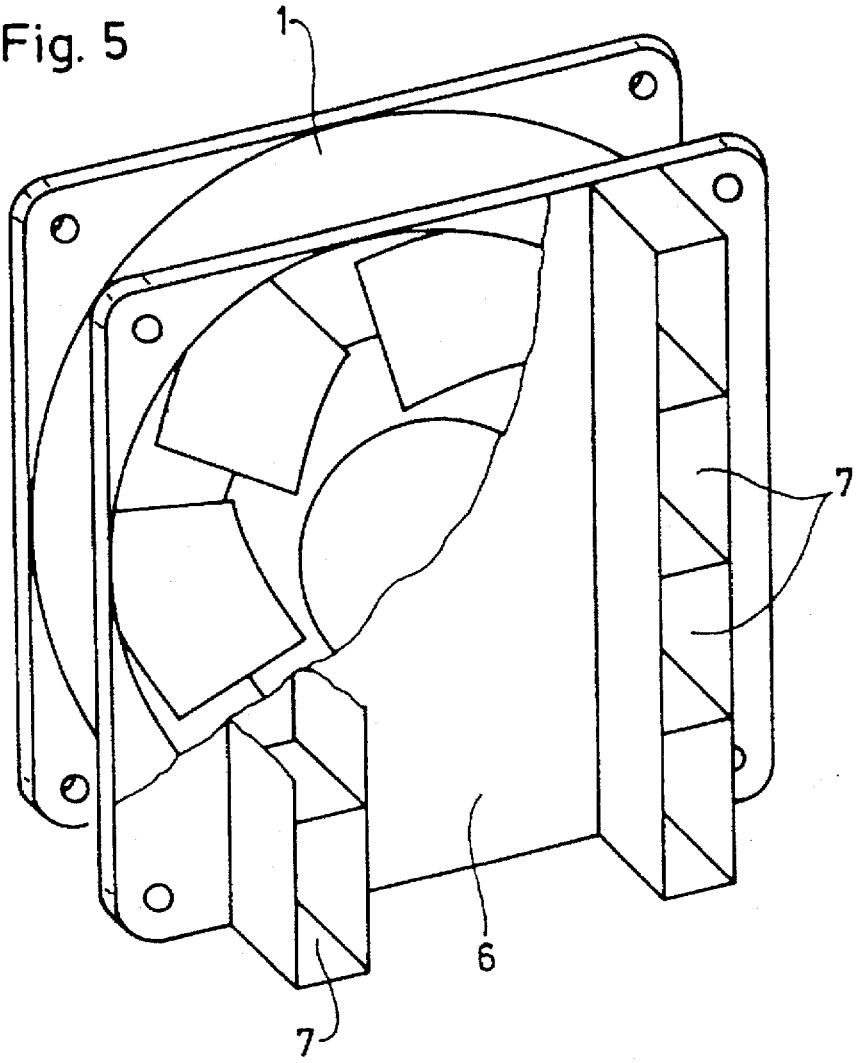
FIG. 5 is a bottom and two sides perspective view of a diagonal-type ventilator or air blower wherein part of the bottom of the ventilator or air blower as well as part of the guiding device are shown broken away.
Figure 4:
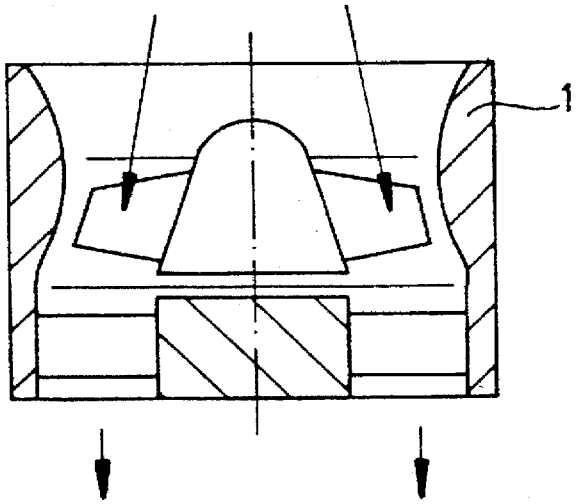
FIG. 4 is a vertical sectional view of a diagonal-type ventilator or air blower equipped with guiding device.

Instead of a radial-type ventilator or air blower, shown in FIGS. 2 and 3, it is also conceivable to use diagonal-type ventilators or air blowers such as are represented in FIGS. 4 and 5, if such diagonal-type ventilators are provided, at the discharge side thereof, with a guiding device 6 which guides the air delivered by the diagonal-type ventilator, at a high flow rate and with the air flow being as laminar as possible, towards and against the upper side of the oncoming sheet 3. As shown in FIG. 5, the underside of the guiding device 6 is provided with a plurality of outlet openings 7 arranged in rows behind one another so that, in the case of the exemplary embodiment of the invention illustrated in FIG. 5, blast air may be discharged from two parallel rows of outlet openings 7. Due to such an arrangement, it is possible to form the outlets 7 as venturi tubes in order to increase the flow rate.

In all of the illustrated exemplary embodiments, a relatively small amount of air is directed, at a relatively high flow rate, purposefully linearly from above against the oncoming sheet 3 for the purpose of slowing down or braking the oncoming sheet and forcing it down onto the sheet pile 4, each individual ventilator being controllable independently of the other ventilators and blast-air devices, respectively, in order to be able to regulate, individually and in a conventional manner, the blast air directed against the sheet 3.

Where appropriate, the aforementioned features of the invention may also be applied to sheet guidance and sheet smoothening at other locations of the printing press, such as, in the printing units or for sheet transfer, for example.

We claim:

1. Sheet delivery for a sheet-processing machine, comprising a conveyor system for transporting sheets successively and for releasing the sheets above a sheet pile having a horizontal surface, and a plurality of ventilators having a controllable output, said ventilators being disposed in an array above the horizontal surface of the sheet pile for directing blown air from above the sheet pile towards respective oncoming sheets successively transported by said conveyor system and released thereby above the sheet pile, said ventilators being formed with respective outlet openings effecting a venturi constriction at respective discharge sides thereof, said ventilators being high-speed ventilators constructed for small air volumes and blowing a concentrated high-speed air jet with laminar flow substantially vertically from above against the respective oncoming sheets.

2. Sheet delivery according to claim 1, wherein said ventilators are radial-type ventilators having respective spiral housings.

3. Sheet delivery according to claim 1, wherein said ventilators are diagonal-type ventilators having respective attachments acting as respective flow-aligning devices.

4. Sheet delivery according to claim 1, including additional blast-air devices in combination with said plurality of ventilators.

* * * * *